US005692842A

United States Patent [19]

Sasai et al.

[11] Patent Number: 5,692,842

[45] Date of Patent: Dec. 2, 1997

[54] GUIDE SHAFT ASSEMBLY FOR A PRINTER

[75] Inventors: Yoji Sasai; Takayuki Okuda, both of Nagano, Japan

[73] Assignee: Seiko Epson Corporation, Tokyo, Japan

[21] Appl. No.: 636,365

[22] Filed: Apr. 23, 1996

[30] Foreign Application Priority Data

Apr. 28, 1995 [JP] Japan ..... 7-129557

[51] Int. Cl.[6] ..... B41J 11/20; B41J 19/66

[52] U.S. Cl. ..... 400/59; 400/629; 400/354

[58] Field of Search ..... 400/629, 55, 56, 400/59, 60, 354.1, 354.2, 354.3, 354

[56] References Cited

U.S. PATENT DOCUMENTS

| | | | |
|---|---|---|---|
| 4,189,244 | 2/1980 | Harrison . | |
| 4,676,675 | 6/1987 | Suzuki et al. | 400/56 |
| 4,720,200 | 1/1988 | Gomoll et al. . | |
| 4,787,759 | 11/1988 | Gets et al. | 400/55 |

FOREIGN PATENT DOCUMENTS

| | | | |
|---|---|---|---|
| 56-133470 | 9/1981 | Japan . | |
| 59-26356 | 2/1984 | Japan . | |
| 0151364 | 7/1987 | Japan | 400/59 |
| 62-270363 | 11/1987 | Japan | 400/59 |
| 1-174149 | 12/1989 | Japan . | |

*Primary Examiner*—Eugene H. Eickholt

*Attorney, Agent, or Firm*—Stroock & Stroock & Lavan LLP

[57] ABSTRACT

A printer is provided having a guide shaft positioned substantially parallel with a printing surface. A print head of the printer is supported by the guide shaft, which is in turn supported by at least a first frame. The first frame is formed with an interior wall forming a through hole in the frame. A bearing member is fitted within the through hole. Upon rotation of the bearing member, the guide shaft is moved in a direction orthogonal to the printing surface.

19 Claims, 14 Drawing Sheets

GUIDE SHAFT ASSEMBLY FOR A PRINTER

BACKGROUND OF THE INVENTION

1. Field of the Invention

The invention relates generally to a printer, and more specifically, the invention is directed to a printer that prints data on a printing surface such as paper by reciprocating a print head along a guide shaft that is arranged in parallel with the printing surface, and to a guide shaft assembly of such printer.

2. Related Art

Generally, in all printers that print data on a printing surface, such as paper or other recording medium, with a print head which reciprocates along a guide shaft that is arranged in parallel with the printing surface, it is necessary that parallelism between the printing surface and the guide shaft be accurately maintained. Further, if one attempts to print on paper or the like which have different thicknesses, it is necessary that the guide shaft be retractable from the printing surface while maintaining parallelism with respect to the printing surface so that the distance between the printing surface and the print head can be properly maintained even if the thicknesses of the paper or the like to be printed upon are different.

A prior art printer known from Unexamined Japanese Utility Model Publication No. Sho. 59-26356 and shown in FIGS. 17 through 23 can accurately adjust the parallelism between the printing surface and the guide shaft. In FIG. 17, the prior art printer includes side plates 5, 6. A slider shaft 4 and a guide shaft 7 are supported between side plates 5, 6. A carriage 3 is slidably mounted on shafts 4, 7 and a print head 2 is mounted on carriage 3. A first end 7*a* of shaft 7 is fixed to side plate 5 and a second end 7*b* thereof is inserted into an elongated hole 6*a* formed in side plate 6 so as to be movable toward a platen 1 as shown in FIG. 18.

A bracket 8 is formed with an insertion hole 8*a* therein into which guide shaft 7 is inserted. Bracket 8 is also formed with an elongated hole 8*b* therein to receive a first screw 9 (see FIG. 20), and an insertion hole 8*c* formed therein for receiving a fine adjustment cam 10 is inserted. As shown in FIG. 22, fine adjustment cam 10 is circular and has a mounting hole 10*a* formed therein for maintaining a second screw 11 (see FIG. 20) at an eccentric position. An adjusting groove 106 is formed in cam 10.

Parallelism between guide shaft 7 and platen 1 is adjusted as follows. First end 7*a* of guide shaft 7 is fixed to first side plate 5. Second end 7*b* of guide shaft 7 is inserted into elongated hole 6*a* of side plate 6, and further into first insertion hole 8*a* of bracket 8. The parallelism of guide shaft 7 is then roughly adjusted by shifting bracket 8 along second side plate 6, and elongated hole 8*b* of bracket 8 is aligned with a first screw hole 6*b* (see FIG. 19) of second side plate 6. This condition is temporarily maintained by first screw 9. Fine adjustment cam 10 is thereafter attached to bracket 8 through second screw hole 6*c* as shown in FIG. 20 and temporarily held with second screw 11. When the fine adjustment cam 10 is rotated through an angle $\alpha$ as shown in FIG. 16, second end 7*b* of guide shaft 7 shifts toward platen 1 by a distance h. Fine adjustment cam 10 is rotated by inserting the tip of a screwdriver or the like into adjusting groove 10*b* to adjust the parallelism of print head 2. Fine adjustment cam 10 is rotated until the parallelism between print head 2 and the printing medium is proper. Thereafter first and second screws 9 and 11 are tightened to complete the adjustment.

It may be noted that such an adjustment to the parallelism is usually made at the printer manufacturing plant, and not by the user.

Another prior art printer known from Unexamined Japanese Utility Model Publication No. Sho. 56-133470 and shown in FIGS. 24 and 25 includes a guide shaft which is made to be retractable from the printing surface of the recording medium while maintaining parallelism with respect to the printing surface so that the distance between the printing surface and the head can be maintained properly even if the thicknesses of the paper or the like being printed upon are different. In FIGS. 24 and 25, parts and components that are similar or corresponding to those of the printer depicted in FIGS. 17–23, are denoted by like reference numerals, and the description thereof will be omitted.

Slider shaft 4 of the printer is rotatably supported by first and second side plates 5 and 6. An eccentric member 20 is fixed to each end of shaft 4 by screws 21. Each eccentric member 20 has a stepped portion 20*b* that is eccentric with respect to an insertion hole 20*a* formed in each end of shaft 4. A first end of each coupling member 22 is coupled to each stepped portion 20*b*, and a second end 22*b* of each coupling member 22 is coupled to each end of guide shaft 7 by screws 23. Guide shaft 7 is positioned in the vertical direction by elongated holes 6*d* formed in respective first and second side plates 5 and 6, and is supported so as to be movable toward and away from the printing surface of a paper or other recording medium which is to be printed upon. A lever 24 is fixed to one of eccentric members 20. An L-shaped engagement member 25 is fixed to first side plate 5. A plurality of recesses 25*a* for regulating the stopping positions of lever 24 are formed in L-shaped engagement member 25.

In the thus constructed printer, when lever 24 is moved, guide shaft 7 advances and retreats simultaneously therewith in a direction perpendicular to the motion thereof. Therefore, the distance between the printing surface and the print head can be adjusted properly even if the thicknesses of paper or the like to be printed on are different. Such adjustment may be made by the user during use.

Another prior art printer known from Unexamined Japanese Utility Model Publication No. Hei. 1-174149 and shown in FIGS. 26 to 28, can adjust the parallelism between the printing surface and the guide shaft. The guide shaft is made retractable from the printing surface while maintaining parallelism with respect to the printing surface so that the distance between the printing surface and the print head can be maintained properly even if the thicknesses of paper or the like to be printed upon are different. In FIGS. 26 to 28, parts and components that are similar or corresponding to those of the printer depicted in FIGS. 17–23, are denoted by like reference numerals, and the description thereof will be omitted.

A guide shaft 30 of this printer has an eccentric shaft portion 30*a* formed on an end thereof as shown in FIG. 27. A bearing member 31 is rotatably fitted in a round hole 32*a* formed in a frame 32. Bearing member 31 is formed with a bearing hole 31*a* that is eccentric with respect to the center of round hole 32*a*. Eccentric shaft portion 30*a* of the guide shaft 30 is rotatably supported by bearing hole 31*a*. Each end portion of guide shaft 30 has a similar construction.

According to this construction, when bearing member 31 is rotated, eccentric shaft portion 30*a* of guide shaft 30 shifts in the directions indicated by the two headed arrow Z in FIG. 28. As a result, parallelism between guide shaft 30 and platen 1 can be adjusted. Further, when eccentric shaft portion 30*a* of guide shaft 30 is rotated, guide shaft 30 advances and retreats in the directions indicated by the double headed arrow Z in FIG. 28 while maintaining parallelism with respect to platen 1. As a result, the distance between the printing surface and print head 2 can be adjusted even if the thicknesses of paper or the like to be printed upon are different.

These printer guide systems have been satisfactory. However, the prior art printer apparatus disclosed in Unexamined Japanese Utility Model Publication No. Sho. 59-26356, and as discussed above, requires a total of four parts for the parallelism adjustment of the guide shaft, as shown in FIG. 20. That is, bracket 8, first screw 9, fine adjustment cam 10, and second screw 11 of the fine adjustment cam must be provided. Thus, this apparatus requires a large number of parts to perform this function.

In contrast thereto, the prior art printer disclosed in Unexamined Japanese Utility Model Publication No. Hei. 1-174149, and as discussed above, requires only two bearing members 31 that support each end of guide shaft 30. That is, this prior art printer requires a smaller number of parts. However, this prior art printer does not address the following problem. When bearing member 31 is rotated, guide shaft 30 tends to shift not only in the directions indicated by the double headed arrow Z in FIG. 28, but also in directions indicated by doubled headed arrow Y. This movement in the Y directions is disadvantageous. As a result, even if each end of guide shaft 30 is positioned equidistantly from platen 1, guide shaft 30 will not always remain parallel with platen 1. Thus, it will be more likely that the axis of guide shaft 30 will be out of parallelism with respect to the axis of platen 1. In order to overcome this problem and to ensure the parallelism of guide shaft 30 with respect to platen 1, bearing members 31, must be rotated separately (independently of each other), which is a procedure that is very inconvenient and complicated.

The prior art printer disclosed in Unexamined Japanese Utility Model Publication No. Sho. 56-133470, and as discussed above, requires a total of 8 parts for making guide shaft 7 retractable from the printing surface with the parallelism of guide shaft 7 maintained with respect to platen 1 as shown in FIG. 24. That is, the pair of eccentric members 20, the pair of screws 21, the pair of coupling members 22, and the pair of screws 23 must be provided in addition to lever 24. Thus, this prior art printer requires a large number of parts to address the problem.

In contrast thereto, the prior art printer disclosed in Unexamined Japanese Utility Model Publication No. Hei. 1-174149, and as discussed above, requires only two bearing members 31 for supporting eccentric shaft portions 30*a* on each end of guide shaft 30. That is, this prior art printer requires a smaller number of parts. However, this prior art printer fails to address the following problem. When bearing member 31 is rotated, guide shaft 30 tends to advance and retreat not only in the directions indicated by the double headed arrow Z in FIGS. 26 and 28, but also shifts in the directions indicated by arrow Y. This movement in the Y directions is disadvantageous. When guide shaft 30 is shifted in the directions indicated by double headed arrow Y, print head 2 is likewise shifted in the directions indicated by double headed arrow Y. Thus, print head 2 may be moved in the paper forward direction. As a result, the print start position of print head 2 with respect to the paper being printed upon is likely to be shifted erratically and a print operation may begin at an improper place on the print surface.

SUMMARY OF THE INVENTION

Generally speaking, in accordance with the invention, a printer is provided which includes a pair of frames. A guide shaft is supported between the frames and arranged in parallel with a printing surface. A print head is supported by the guide shaft for printing data on the printing surface while reciprocating along the length of the guide shaft. The pair of frames support end portions of the guide shaft. At least one of the pair of frames is formed with a through hole formed therein. The frame is also formed with a straight contact side extending in a direction orthogonal to the printing surface. A guide member supports one end portion of the guide shaft while being rotatably fitted in the through hole. The guide member is formed of a resilient material so that the one end portion of the guide shaft is biased onto the contact side of the frame and thus is maintained in contact with the frame.

The printer through hole is formed with a second side in facing relationship with the contact side and running parallel thereto and being spaced therefrom, and third and fourth sides running between and perpendicular to the contact side and the second side, at least these four sides essentially forming a substantially square cutout portion in the frame. The end portion of the guide shaft is formed with a first arcuate surface which comes into contact with the contact side, and the bearing member is formed with a second arcuate surface which comes into contact with the second side and third and fourth arcuate surfaces which come into contact with the third and fourth sides, respectively.

In one embodiment, the printer includes a guide shaft arranged in parallel with a printing surface and a print head which is supported by the guide shaft and which is designed to print data on the printing surface while reciprocating along the length of the guide shaft. A pair of frames support end portions of the guide shaft, at least one of the pair of frames being formed with a through hole formed therein. The frame is formed with a straight contact side extending in a direction orthogonal to the printing surface. A guide member, rotatably fitted in the through hole, supports one end portion of the guide shaft and brings the end portion of the guide shaft into contact with the contact side of the frame. The through hole includes a second side in facing relationship with the contact side and running parallel thereto and spaced therefrom, and third and fourth sides running between and perpendicular to the contact side and the second side, the four sides essentially forming a substantially square cutout portion in the frame. The end portion of the guide shaft has a first arcuate surface which comes into contact with the contact side, and the bearing member has a second arcuate surface which comes into contact with the second side and third and fourth arcuate surfaces which come into contact with the third and fourth sides, respectively. The second arcuate surface is an arcuate surface subtending a center of the first arcuate surface. The third and fourth arcuate surfaces are arcuate surfaces which share a common center and radius of curvature.

If it is assumed that:

the center of the first arcuate surface is $O_1$ and the radius of curvature thereof is $R_1$;

the radius of curvature of the second arcuate surface is $R_2$;

the center of the third and fourth arcuate surfaces is $O_3$ and the radius of curvature thereof is $R_3$; and a distance between the center $O_1$ of the first arcuate surface and the center $O_3$ of the third arcuate surfaces is A;

then the following relational expressions are satisfied:

$$R_1+R_2=2R_3$$

$$R_3-R_1=A.$$

In another embodiment, the bearing member is made of a resilient material. Additionally, the end portion of the guide shaft and the frame may be made of metal, and the frame may be electrically grounded in the printer. Further, the end portions of the guide shaft are constructed of eccentric shaft portions being eccentric with respect to the center of the guide shaft.

An additional embodiment of the invention provides a printer having a pair of frames. A guide shaft is formed with eccentric shaft portions on both ends thereof, is arranged in parallel with a printing surface and is supported between the frames. A print head is supported by the guide shaft for printing data on a printing surface while reciprocating along the length of the guide shaft. The pair of frames rotatably support the eccentric shaft portions of the guide shaft. An operation lever for rotating the eccentric shaft portions is also provided, the operation lever being selectively positionable between a first stopping position and a second stopping position, wherein the first stopping position and the second stopping position correspond to first and second positions of the eccentric shaft portions rotating equal angles in a clockwise direction or a counterclockwise direction with respect to a reference line running in parallel with the printing surface and passing through the center of the eccentric shaft portions. The additional embodiment of the invention further includes eccentric shaft portions constructed so as to be eccentric with respect to the center of the guide shaft. Additionally, the print head is an ink jet print head for ejecting ink droplets onto the printing surface. A cap for covering an ink ejecting surface of the print head is arranged adjacent an end portion of the guide shaft.

According to the printer of the invention, the print head is supported by the guide shaft that is in turn supported by the frames, so that data is printed on the printing surface with the print head reciprocating along the length of the guide shaft. At least one end portion of the guide shaft is supported by a bearing member that is rotatably fitted in a through hole formed in one of the frames. The bearing member is made of a resilient material and biases the end portion of the guide shaft onto a straight contact side of the hole by the resiliency thereof. As a result, when the bearing member is rotated, the end portion of the guide shaft is caused to move along the straight contact side. Since the straight contact side extends in the direction orthogonal to the printing surface, the end portion of the guide shaft moves only in the direction orthogonal to the printing surface. That is, according to the printer of the invention, parallelism between the printing surface and the guide shaft can be adjusted by only rotating the bearing member. In addition, since the end portion of the guide shaft moves only in the direction orthogonal to the printing surface, this parallelism adjustment can be made easily. Moreover, since it is only the bearing member that is required for the parallelism adjustment of the guide shaft, the number of parts required to make the adjustment can be reduced.

Additionally, the through hole formed in the frame has a second side in facing relationship with the contact side and runs parallel thereto, and spaced therefrom, as well as third and fourth sides that are continuous with the contact side and the second side are situated perpendicular thereto and in facing relationship with each other, thus forming a substantially square cutout in the frame. The end portion of the guide shaft has a first arcuate surface that comes in contact with the contact side. The bearing member has a second arcuate surface that comes in contact with the second side and third and fourth arcuate surfaces that come in contact with the third and fourth sides, respectively. Therefore, the bearing member can be rotated smoothly. Hence, parallelism between the printing surface and the guide shaft can be adjusted more easily. Furthermore, the print head is supported by the guide shaft that is in turn supported by the frames. The print head prints upon the printing surface while reciprocating along the length of the guide shaft.

Further, a through hole is formed in one of the pair of frames supporting the end portions of the guide shaft. This through hole has a straight contact side extending in the direction orthogonal to the printing surface. A second side is in facing relationship with the contact side and running parallel thereto. Third and fourth sides are formed continuous with the contact side and the second side, are situated perpendicular thereto and are in facing relationship with each other. The end portion of the guide shaft supported by a bearing member that is rotatably fitted in this through hole has a first arcuate surface that comes in contact with the contact side. The bearing member has a second arcuate surface that comes in contact with the second side, and third and fourth arcuate surfaces that come in contact with the third and fourth sides, respectively. In addition, the second arcuate surface subtends the center of the first arcuate surface; i.e., the second arcuate surface is concentric with the first arcuate surface. The third and fourth arcuate surfaces share a common center and a common radius of curvature.

If it is assumed that the center of the first arcuate surface is $O_1$ and the radius of curvature thereof is $R_1$, the radius of curvature of the second arcuate surface is $R_2$, the center of the third and fourth arcuate surfaces is $O_3$ and the radius of curvature thereof is $R_3$, and the distance between the center $O_1$ of the first arcuate surface and the center $O_3$ of the third and fourth arcuate surfaces is A, then the following relational expressions are satisfied: $R_1+R_2=2R_3$ and $R_3-R_1=A$. Therefore, when the bearing member is rotated, the center $O_1$ on the end portion of the guide shaft moves in parallel with the contact side with the center $O_3$ of the third and fourth arcuate surfaces moving in the direction orthogonal to the contact side. Therefore, the first arcuate surface on the end portion of the guide shaft moves along the straight contact side so as to remain in contact with the contact side. Since the straight contact side extends in the direction orthogonal to the printing surface, the end portion of the guide shaft moves only in the direction orthogonal to the printing surface. That is, the printer of the invention can adjust the parallelism between the printing surface and the guide shaft only by turning the bearing member even if the bearing member is not made of a resilient material. In addition, since the end portion of the guide shaft moves only in the direction orthogonal to the printing surface, the parallelism adjustment can be made easily. Further, since the bearing member is the only part that is required for the parallelism adjustment of the guide shaft, the number of parts employed may be reduced.

Additionally, according to the invention, the bearing member may be made of a resilient material. Therefore, even if the aforementioned relational expressions $R_1+R_2=2R_3$ and $R_3-R_1=A$ are not satisfied strictly, the end portion of the guide shaft is biased onto the contact side by the resiliency of the bearing member, which in turn allows the end portion of the guide shaft to move along the straight contact side. Therefore, the bearing member can be manufactured more easily.

Moreover, in the printer constructed according to the invention, the end portion of the guide shaft as well as the frame is made of metal and the frame is grounded in the printer. Therefore, the guide shaft can be grounded without employing any special parts. Additionally, the end portions of the guide shaft are eccentric with respect to the center of the guide shaft. Therefore, by rotating the eccentric shaft portions, the guide shaft is allowed to advance toward and retract from the printing surface while maintaining parallelism with respect to the printing surface.

According to another embodiment of the invention, the print head is supported by a guide shaft, which in turn is supported by a pair of frames, and prints data on a printing surface while reciprocating along the length of the guide shaft that is in parallel with the printing surface. The guide shaft has eccentric shaft portions on both ends thereof,-and these eccentric shaft portions are rotatably supported by the pair of frames. Therefore, by rotating these eccentric shaft portions, the guide shaft is allowed to advance toward and retract from the printing surface while maintaining parallelism with respect to the printing surface.

This printer also has an operation lever for rotating the eccentric shaft portions, the operation lever being selectively positionable between first and second stopping positions that regulate the stopping of the operation lever. Therefore, the operation lever stops only in the first or the second stopping position. The first and second stopping positions are arranged so as to correspond to first and second positions of movement by the eccentric shaft portions rotating equal angles in a clockwise direction or in a counterclockwise direction from a reference line that runs parallel with the printing surface and passes through the center of the eccentric shaft portions. Therefore, the guide shaft stops at positions about the eccentric shaft portions corresponding to the first and second stopping positions. Hence, by turning the operation lever to the first or the second stopping position, the guide shaft can be advanced toward or retracted from the printing surface without shifting in the paper forward direction, while maintaining parallelism with respect to the printing surface. Further, since the guide shaft does not shift in the paper forward direction, the print start position with respect to the paper is in no way shifted erratically and the subsequent print operation will begin at the proper position. In addition, only the operation lever is required for the parallelism positioning employed in this operation. This printer allows the guide shaft to advance toward and retract from the printing surface without shifting in the paper forward direction. Thus, the parallelism of the guide shaft is maintained with respect to the printing surface utilizing a reduced number of parts.

Additionally, according to the printer of this embodiment, the end portions of the guide shaft are eccentric with respect to the center of the guide shaft. Therefore, by rotating the eccentric shaft portions, the guide shaft is allowed to advance toward and retract from the printing surface while maintaining parallelism with respect to the printing surface. If the print head is an ink jet head that ejects ink droplets onto the printing surface, the print head must be covered with a cap when the printer is not in use or in a like condition. This cap is arranged adjacent the end portion of the guide shaft. Therefore, if, as in the prior art, the guide shaft, and the print head, shifts in the paper forward direction when the parallelism of the guide shaft is adjusted, or when the guide shaft is advanced toward or retracted from the printing surface, then the cap and the print head will be out of position. Thus, the ink ejecting surface of the print head will not be covered by the cap properly. In contrast thereto, in the printer constructed according to the second embodiment of the invention, the guide shaft does not shift in the paper forward direction even if the parallelism of the guide shaft is adjusted, or if the guide shaft is advanced toward and retracted from the printing surface. Therefore, the ink ejecting surface of the head can always be covered properly by the cap.

Accordingly, it is an object of the present invention is to provide a printer that can adjust parallelism of a guide shaft with respect to a printing surface easily with a reduced number of parts.

Another object of the invention is to provide a printer which allows a guide shaft to advance toward and retract from a printing surface without shifting in the paper forward direction and which maintains the parallelism of the guide shaft with respect to the printing source employs a reduced number of parts.

Still other objects and advantages of the invention will in part be obvious and will in part be apparent from the specification and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
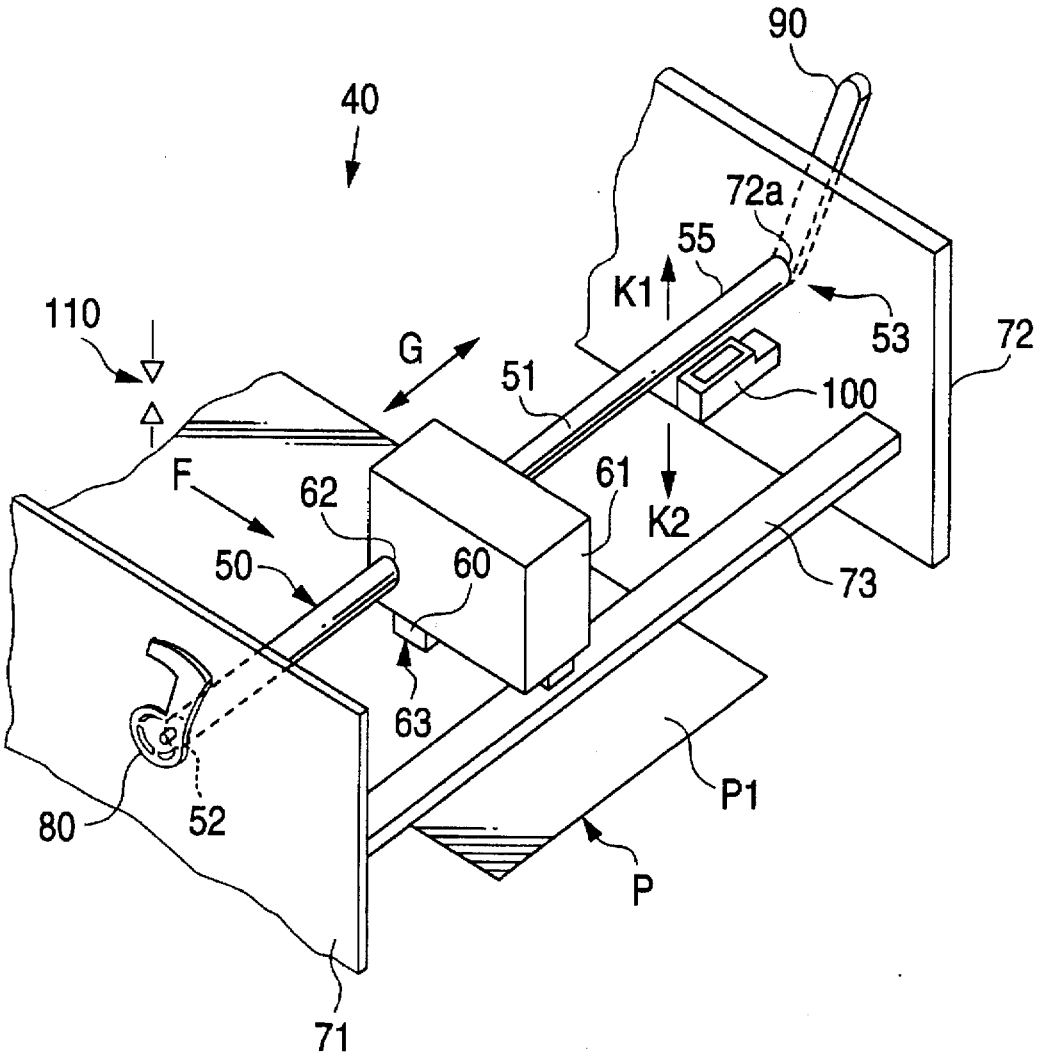
FIG. 1 is a perspective view of a guide shaft assembly of a printer constructed in accordance with a first embodiment of the invention.

Reference is first made to FIG. 1, which is a perspective view showing a main portion of a printer constructed in accordance with a first embodiment of the invention. An ink jet printer 40, a portion of which is shown in FIG. 1, is formed with side frames 71, 72. A guide shaft 50 is supported between frames 71, 72. A print head 60 is slidably supported on shaft 50. A bearing member 80, supported on side frame 71, is mounted on one end of guide shaft 50. An operation lever 90 is mounted on side plate 72 and receives the other end of guide shaft 50. A cap 100 for capping ink jet print head 60 when not printing is mounted on frame 72 adjacent guide shaft 50. A sheet detector 110, for detecting the presence of a sheet is disposed along the feed path of a paper sheet P.

Figure 2:
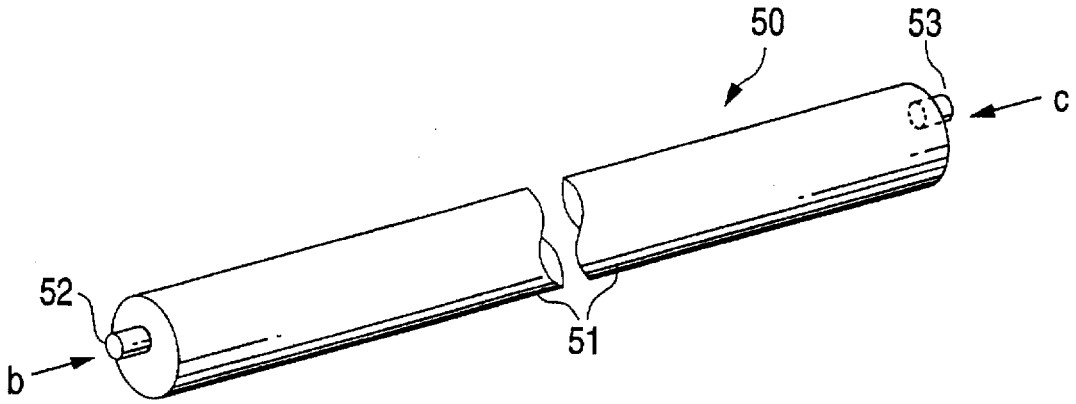
FIG. 2 is a perspective view of a guide shaft constructed in accordance with the first embodiment of the present invention.
Figure 3:
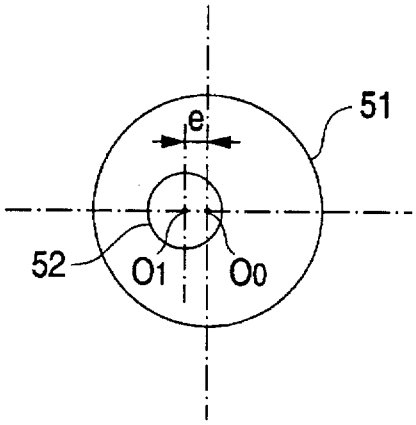
FIG. 3 is a side elevational view of the guide shaft of FIG. 2 from the direction of arrow b.
Figure 4:
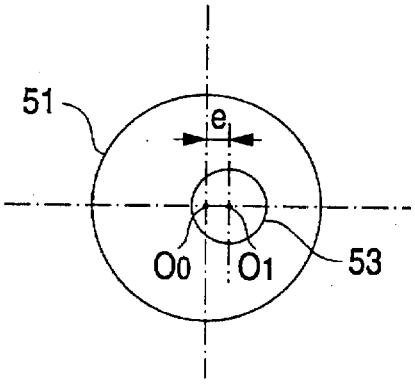
FIG. 4 is a side elevational view of the guide shaft of FIG. 2 from the direction of arrow c.

Guide shaft 50 is made of metal and has, as shown in FIG. 2, a large diameter portion 51 and first and second small diameter portions 52 and 53 formed on respective ends of large diameter portion 51. As shown in FIGS. 3 and 4, the center $O_1$ of each of small diameter portions 52 and 53 is eccentric with respect to the center $O_0$ of the large diameter portion 51, and is offset by a distance e from each other. Therefore, each small diameter portion 52, 53 is formed as an eccentric shaft portion.

Thus, as is further shown in FIG. 1, guide shaft 50 is not only provided with first small diameter portion 52 rotatably supported by first frame 71 through bearing member 80, but also is provided with second small diameter portion 53 rotatably supported by second frame 72. Second small diameter portion 53 passes through second frame 72 so that second small diameter portion 53 thereof projects sideways relative to frame 72. Operation lever 90 is fixed to second small diameter portion 53.

A carriage 61 is slidably supported by guide shaft 50. Print head 60 is fixed to carriage 61. A bearing hole 62 is formed in the lower rear portion of carriage 61. Guide shaft 50 is inserted into bearing hole 62 to support print head 60. A guide rail 73 bridges between first and second frames 71 and 72. The lower front portion of carriage 61 is slidably supported by guide rail 73.

Print head 60 may be an ink jet print head and prints data on a printing surface P1 of a sheet of paper P, or other recording medium, by ejecting ink droplets from an ink ejection surface (lower surface) 63 of print head 60. It may be noted that paper P is forwarded in a direction indicated by an arrow F by a forwarding means (not shown) and that carriage 61 moves reciprocally in directions indicated by the double headed arrow G while being driven by a drive mechanism (not shown). That is, printer 40 is designed so that data is printed on printing surface P1 while paper P is being forwarded in the paper path direction and while print head 60 is reciprocating. Applicants note that this invention is described in connection with an ink jet printer, but is applicable to any reciprocating print head.

Figure 5:
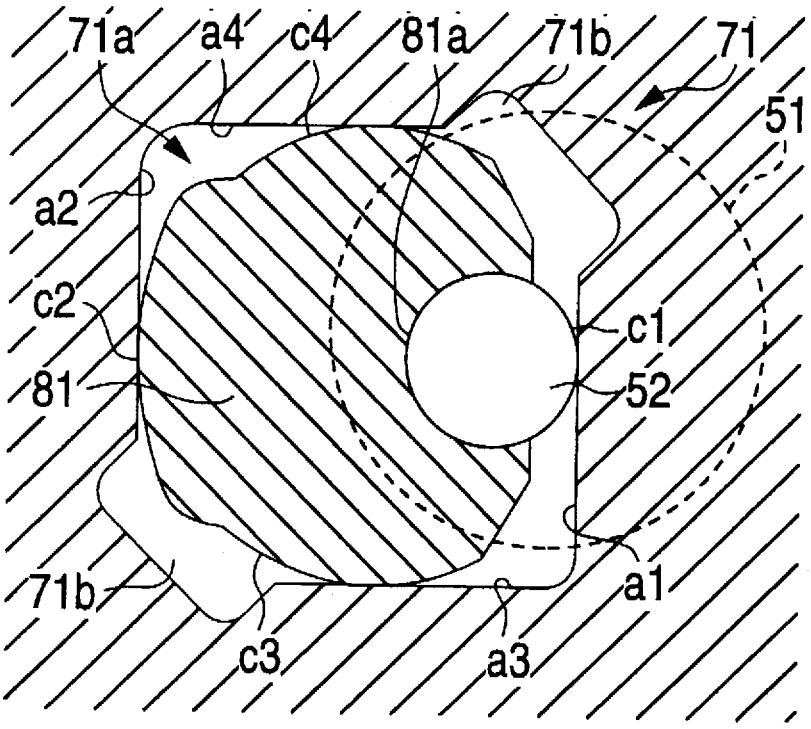
FIG. 5 is a side cross-sectional view showing a bearing portion of a bearing member and a hole formed in a frame constructed in accordance with the first embodiment of the invention.

Frames 71 and 72 are made of metal. As shown in FIG. 5, first frame 71 has a substantially square hole **71*a* formed therein. Second frame 72 has a bearing hole 72*a* (see FIG. 1) that supports second small diameter portion 53. It may be noted that at least one of frames 71 and 72** is grounded.

As shown in FIG. 5, substantially square hole **71*a* has a straight contact side a1 extending in a direction orthogonal to printing surface P1 (see FIG. 1), a second side a2 facing contact side a1 and which is positioned substantially parallel thereto, and third and fourth sides a3 and a4 which are perpendicular to sides a1 and a2, the sides a1, a2, a3 and a4 contacting each other to form substantially continuous square hole 71*a***.

As shown in FIGS. 5 to 9, bearing member 80 has a bearing portion 81, a holding portion 82, first and second holding pieces **83*a* and 83*b*, and an adjusting lever 84. Bearing portion 81 is rotatably fitted into substantially square hole 71*a* of first frame 71. Holding portion 82 is arranged on an outer surface 71*d* of first frame 71 and first and second holding pieces 83*a* and 83*b* are arranged on an inner surface 71*c* of first frame 71 and are provided to prevent bearing portion 81 from accidentally being removed from substantially square hole 71*a*. These components 81, 82, 83*a*, 83*b*, 84** are made of a resilient material such as a synthetic resin having resiliency so as to be coupled with one another.

Figure 6:
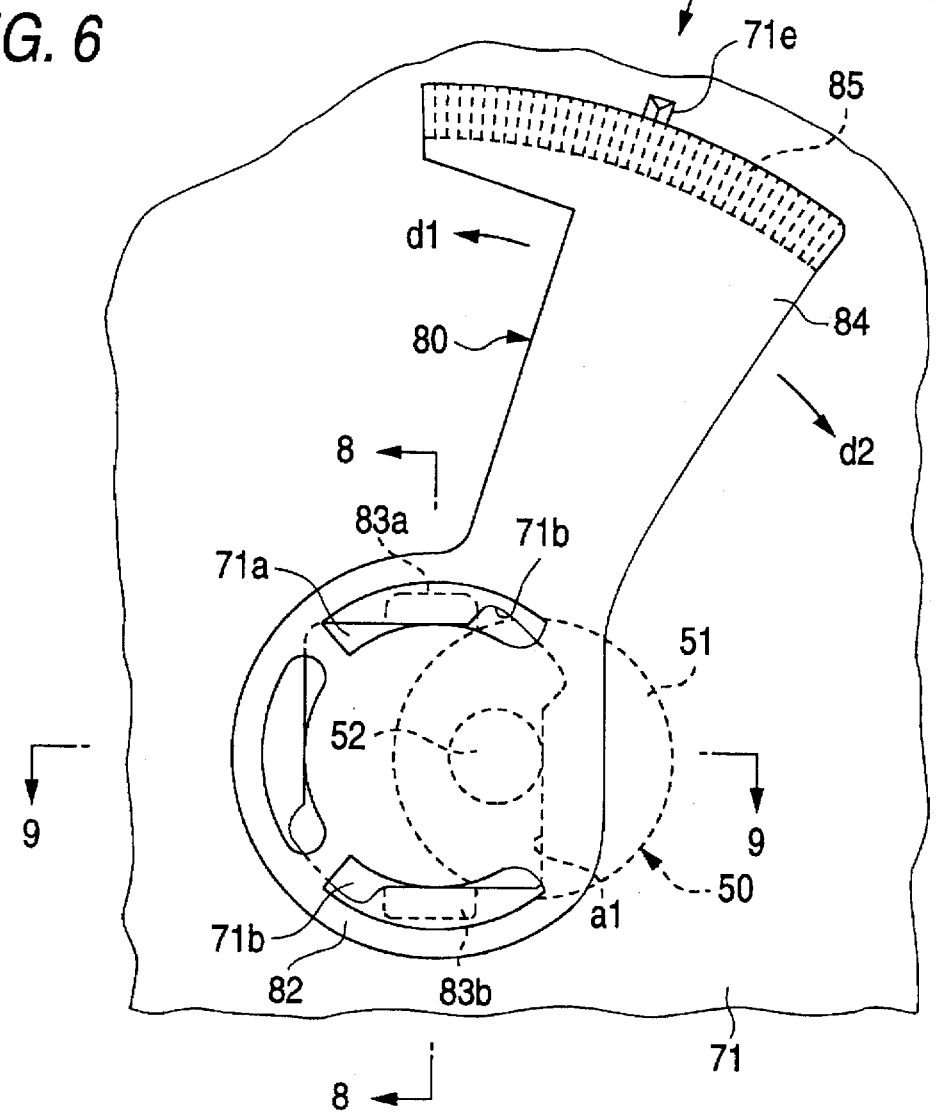
FIG. 6 is a side elevational view showing the bearing member and the frame constructed in accordance with a first embodiment of the invention.
Figure 8:
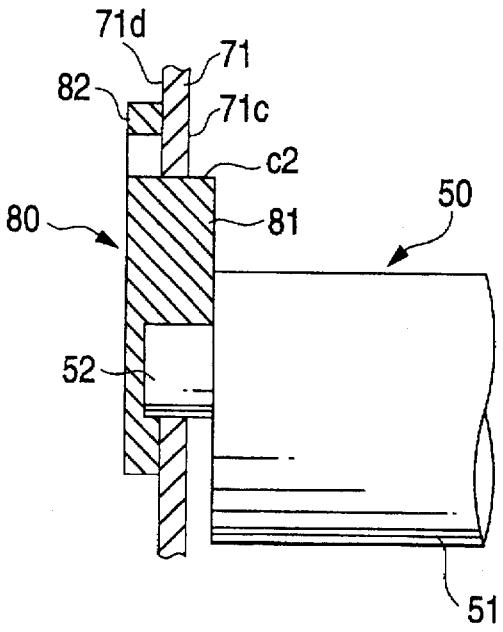
FIG. 8 is a cross-sectional view taken along line 8—8 of FIG. 6.
Figure 9:
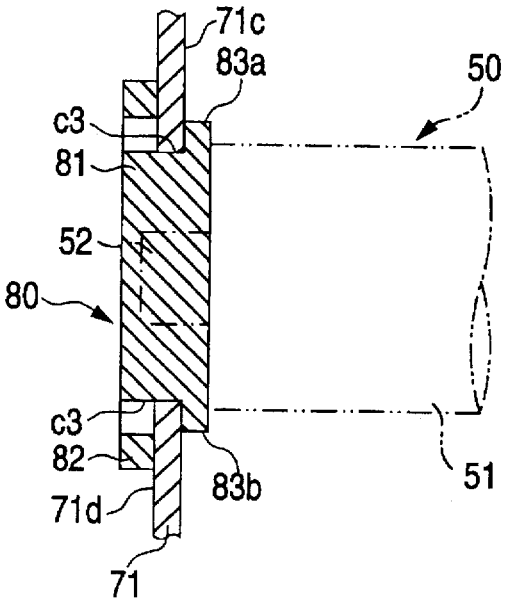
FIG. 9 is a cross-sectional view taken along line 9—9 of FIG. 6.

Bearing member 80 is mounted on first frame 71 by aligning first and second holding pieces **83*a* and 83*b* with insertion openings 71*b* that are formed at the corners of substantially square hole 71*a*. This alignment allows bearing portion 81 to be fitted into substantially square hole 71*a* from outside of frame 71. When adjusting lever 84 is thereafter rotated in a direction indicated by an arrow d1 in FIG. 6, holding pieces 83*a* and 83*b* come into contact with inner surface 71*c* of frame 71, as shown in FIG. 6, and holding portion 82 comes in contact with outer surface 71*d* of frame 71, whereby bearing portion 81 becomes rotatably fixed within substantially square hole 71*a*. As a result, bearing member 80 is rotatably attached to frame 71**.

As shown in FIG. 3, bearing portion 81 has a retaining portion **81*a* that rotatably retains first small diameter portion 52 of guide shaft 50. First small diameter portion 52, which is formed as an eccentric shaft portion, has a first arcuate surface c1, having a center $O_1$, that comes in contact with contact side a1 of substantially square hole 71*a* of first frame 71. Further, bearing portion 81 has a second arcuate surface c2 and third and fourth arcuate surfaces c3, c4. Second arcuate surface c2 comes in contact with second side a2 of substantially square hole 71*a* of first frame 71. Third and fourth arcuate surfaces c3, c4 come in contact with third and fourth sides a3 and a4**, respectively.

Figure 10:
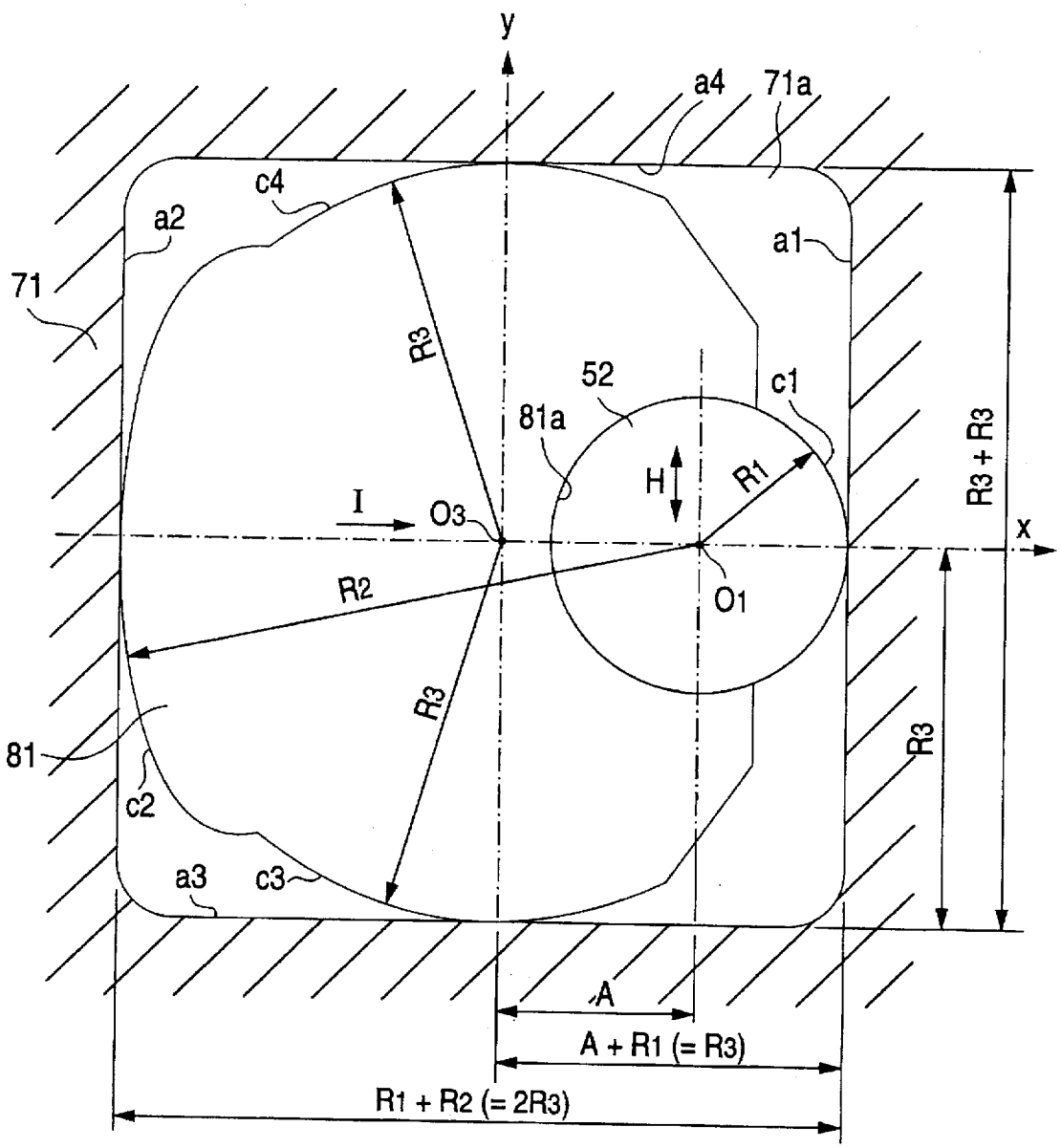
FIG. 10 is a diagram illustrative of the relationship between the bearing portion of the bearing member and the through hole formed in the frame.

FIG. 10 is a diagram schematically depicting a relationship among first small diameter portion 52 of guide shaft 50, substantially square hole 71*a* of first frame 71, and bearing portion 81. In the first embodiment, the shape and dimensions of first small diameter portion 52, substantially square hole 71*a*, and bearing portion 81 are substantially defined as follows.

Second arcuate surface c2 is an arcuate surface having its center $O_2$ in common with the center $O_1$ of arcuate surface c1; i.e., the former is concentric with respect to the latter. The third and fourth arcuate surfaces c3 and c4 have their center $O_3$ in common and each have the same radius of-curvature $R_3$.

If it is assumed that:

the radius of curvature of first arcuate surface c1 is $R_1$;

the radius of curvature of second arcuate surface c2 is $R_2$; and the amount of eccentricity, A, is defined as the distance between the center $O_1$ of first arcuate surface c1 and the center $O_3$ of third arcuate surfaces c3, c4;

and, the respective values are set so that the following relational expressions are satisfied:

$$R_1+R_2=2R_3 \quad (1)$$

$$R_3-R_1=A \quad (2)$$

and if the distance between contact side a1 and second side a2 is set to $R_1+R_2$, and if the distance between third and fourth sides a3 and a4 is set to $2R_3$, then the following operation can be performed if these dimensional requirements are met with high accuracy.

That is, when bearing portion 81 is rotated, center $O_1$ of first arcuate surface c1 of first small diameter portion 52 which is formed as an eccentric shaft portion, moves in directions indicated by double headed arrow H, which is parallel with contact side a1. Portion 52 is formed as an eccentric shaft portion. Center $O_3$ of third and fourth arcuate surfaces c3, c4 moves in a direction orthogonal to contact side a1 (in the direction indicated by double headed arrow I).

This operation will be further described with reference to FIGS. 10 and 11. When bearing portion 81 has not yet been rotated, as shown in FIG. 10, center $O_3$ of third and fourth arcuate surfaces c3, c4 is positioned at the center of substantially square hole 71*a*. The third and fourth arcuate surfaces c3 subtend center $O_3$ since they have a radius of curvature $R_3$ and since $A+R_1=R_3$ from equation (2).

Figure 11:
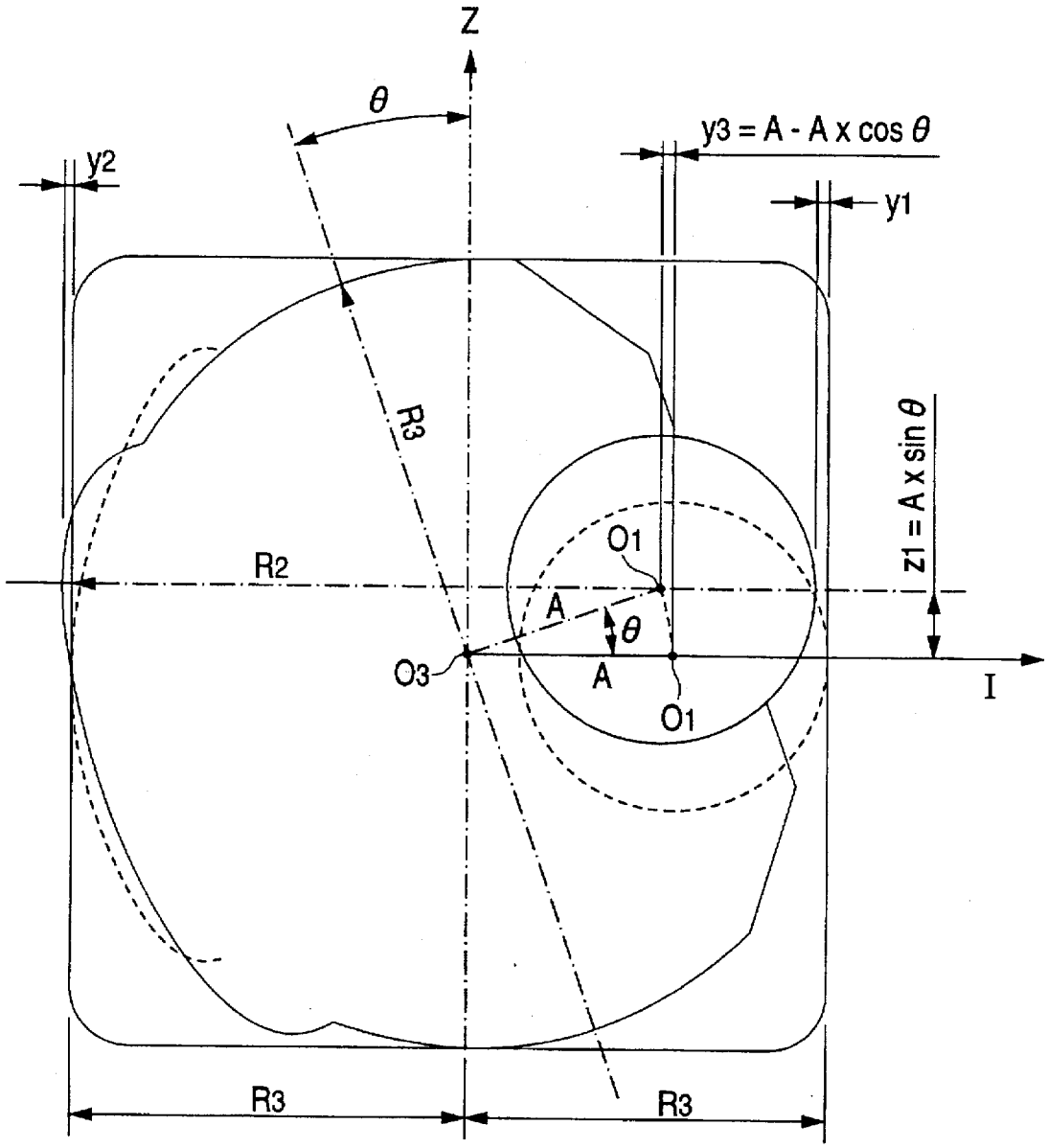
FIG. 11 is a diagram illustrative of an operation of movement of the guide shaft in accordance with the invention.

Let center $O_3$ of third and fourth arcuate surfaces c3, c4 be fixed in FIG. 11 to simplify explanation of the operation. When bearing portion 81 is rotated by an angle θ, if a displacement $y_1$ on the end of first arcuate surface c1 closest contact side a1, in the direction I, is equal to a displacement $y_2$ on the end of the second arcuate surface c2 away from contact side a1, in the direction of arrow I, then it can be verified that the center $O_3$ of third and fourth arcuate surfaces c3, c4 shifts only by $y_1$ ($=y_2$) in the direction I.

The displacement $y_1$ of first arcuate surface c1 on the end thereof closest contact side a1, in the direction of arrow I obtained at the time bearing portion 81 is turned by the angle θ is equal to a displacement $y_3$ of the center $O_1$ of the first arcuate surface c1 ($y_3=A-A\times\cos\theta$).

That is, $y_1=y_3$.

On the other hand, the displacement $y_2$ of second arcuate surface c2 on the end farthest from contact side a1 in the direction of arrow I is given as $$y_2=R_2-R_3-(A-y_3)=R_2-R_3-(R_3-R_1-y_3)=R_2-2R_3+R_1+y_3=(R_1+R_2)-2R_3+y_3=2R_3-2R_3+y_3=y_3$$

Hence, $y_1=y_3=y_2$. Thus, if bearing portion 81 is rotated by the angle θ, it is understood that center $O_3$ of third and fourth arcuate surfaces c3, c4 shifts only by $y_1$ ($=y_2$) in the direction Y. Further, when bearing portion 81 is turned by the angle θ, center $O_1$ of the first arcuate surface c1 is displaced only by $z_1=A\times\sin\theta$ in the direction Z as is apparent from FIG. 8. Center $O_1$ is also displaced an amount $y_3$ in the Y direction, as is noted above.

Figure 12:
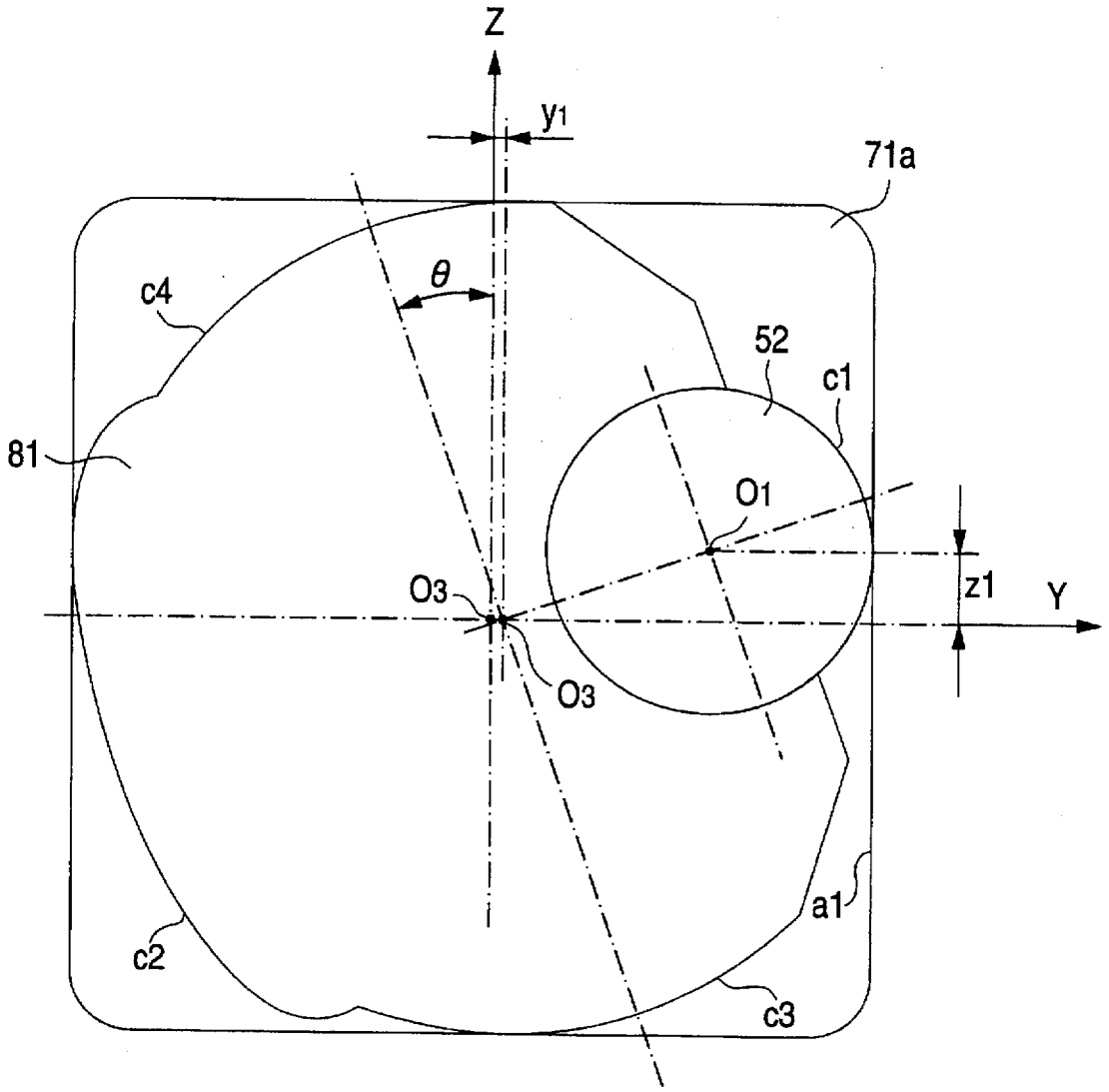
FIG. 12 is a diagram illustrative of the operation of movement of the guide shaft in accordance with the invention.

As is apparent from the foregoing explanation, when bearing portion 81 is rotated as shown in FIG. 12, if the aforementioned dimensional requirements are met with high accuracy, center $O_1$ of arcuate surface c1 of first small diameter portion 52 moves in the direction indicated by the double headed arrow Z which is parallel with contact side a1. Also, center $O_3$ of third and fourth arcuate surfaces c3, c4 moves in the direction orthogonal to contact side a1 (in the direction indicated by the double headed arrow Y). Therefore, first arcuate surface c1 of end portion 52 of guide shaft 50 moves along straight contact side a1 while being maintained in contact with contact side a1. Since straight contact side a1 extends in the direction orthogonal to printing surface P1, first small diameter portion 52 of guide shaft 50 moves only in the direction orthogonal to printing surface P1.

That is, if the aforementioned dimensional requirements are met with high accuracy, bearing portion 81, and bearing member 80 need not be made of a resilient material and need not have any resiliency. That is, even if bearing member 80 is not made of a resilient material or does not have any resiliency, parallelism between printing surface P1 and guide shaft 50 can be adjusted by turning only bearing member 80. In addition, since first small diameter portion 52 of guide shaft 50 moves only in the direction orthogonal to printing surface P1, this parallelism adjustment can be made easily.

Alternatively, if bearing portion 81 is made of a resilient material, first small diameter portion 52 of guide shaft 50 becomes biased onto contact side c1 by the resiliency of bearing portion 81. Therefore, the aforementioned operation can be performed even if the dimensional requirements are not met with high accuracy. That is, when bearing portion 81 is rotated, center $O_1$ of first arcuate surface c1 moves in the direction indicated by the arrows Z in parallel with contact side c1. Center $O_3$ of the third and fourth arcuate surfaces c3, c4 moves in the direction orthogonal to first contact side a1 (in the direction indicated by the arrow I). Hence, it is not necessarily required that the aforementioned dimensional requirements be met with high accuracy if bearing portion 81 is formed of a resilient material. It is only required that bearing portion 81, made of a resilient material, be rotatably fitted in substantially square hole 71*a* to support first small diameter portion 52 of guide shaft 50, and that bearing portion 81 biases first small diameter portion 52 of guide shaft 50 onto contact side a1 by the resiliency thereof. As long as these conditions are satisfied, the shape and the like of substantially square hole 71*a* and bearing portion 81 are not limited to those shown in the drawings.

Additionally, if bearing portion 81 is formed with second arcuate surface c2 that comes in contact with second side a2 and third and fourth arcuate surfaces c3, c4 that come in contact with third and fourth sides a3 and a4 of substantially square hole 71*a*, smoother turning operations can be performed. In addition, if the shape and dimensions of these arcuate surfaces are dimensioned to satisfy the aforementioned settings, or approximately satisfy such settings, further smoother turning operations can be performed.

Thus, this first embodiment of the invention is preferably designed to have the following construction. Bearing portion 81 is force-fit into substantially square hole 71*a* by forming bearing portion 81 of a resilient material, and setting the radii of curvature of second arcuate surface c2 and the third and fourth arcuate surfaces c3, c4 to values slightly larger than the aforementioned geometrically ideal dimensions $R_2$, $R_3$.

Figure 7:
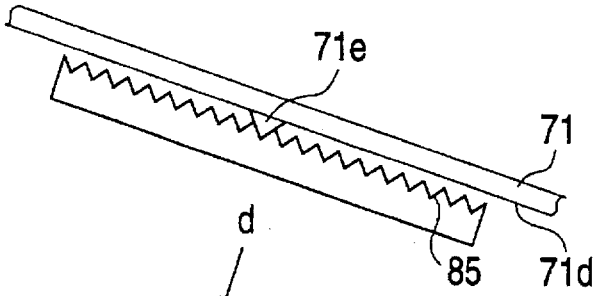
FIG. 7 is a top plan view of the bearing member and the frame of FIG. 5 from the direction of arrow d.

Additionally, as shown in FIG. 7, adjusting lever 84 of bearing member 80 is formed with a knurled portion 85 that is arranged arcuately on the inner surface of the upper end of the adjusting lever 84. Furthermore, first frame 71 has a projection 71*e* on outer surface 71*d* thereof. This projection 71*e* is selectively engageable with knurled portion 85 of adjusting lever 84. Therefore, the parallelism of guide shaft 50 is adjusted by rotating adjusting lever 84 with resiliency that causes the adjusting lever to flex in a direction orthogonal to outer surface 71*d* of the frame so that projection 71*e* is alternatively engaged and disengaged between knurled portions 85 of adjusting lever 84. After adjustment, adjusting lever 84 is fixed in position with knurled portion 85 engaged with projection 71*e*, thereby retaining adjusting lever 84 in a fixed position. This adjusting operation is preferably performed at the factory when printer 40 is assembled.

Figure 13:
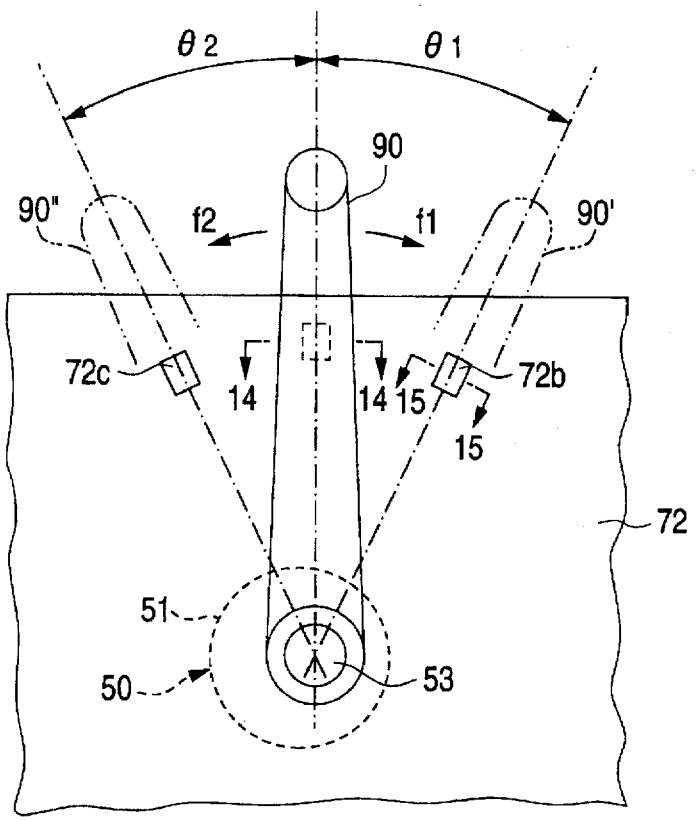
FIG. 13 is a diagram showing a side elevational view of an operation lever and a frame.
Figure 14:
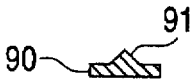
FIG. 14 is a cross-sectional view taken along line 14—14 of FIG. 13.
Figure 15:
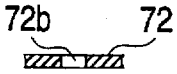
FIG. 15 is a cross-sectional view taken along line 15—15 of FIG. 13.

As described above, operation lever 90 is fixed to the end of second small diameter portion 53 that passes through second frame 72 (see FIG. 1). FIG. 13 is a side view showing operation lever 90 in its mounted position. Projection 91 is formed extending from the side of operation lever 90 facing second frame 72 (see FIG. 14). A pair of through holes 72*b*, 72*c* are formed in second frame 72. Projection 91 is further dimensioned to be engageably fitted into each of the pair of first and second holes 72*b*, 72*c*. The cross section of first hole 72*b* is shown in FIG. 15. Second hole 72*c* has the same shape. First and second through holes 72*b*, 72*c* regulate the stopping positions of operation lever 90 as it is rotated during operation. First hole 72*b* defines a first stopping position 90' and second hole 72*c* defines a second stopping position 90". That is, when operation lever 90 is rotated in the clockwise direction f1 from a neutral position indicated by the solid line in FIG. 13, the position at which projection 91 engages with first hole 72*b* is defined as first stopping position 90'. When operation lever 90 is rotated in the counterclockwise direction f2, the position at which projection 91 engages with second hole 72*c* is defined as second stopping position 90".

Figure 16:
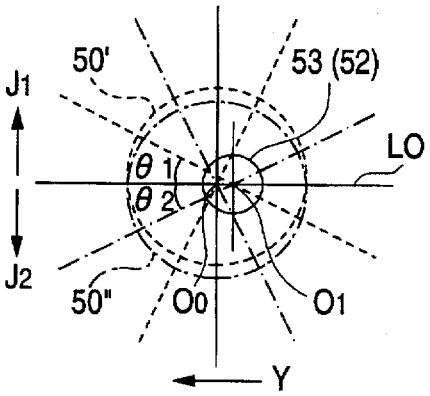
FIG. 16 is a diagram illustrative of an operation of the operation lever in accordance with the invention.

As shown in FIG. 16, these first and second stopping positions 90' and 90" correspond to positions of second small diameter portion 53 rotating by an angle θ1 in the clockwise direction or by an angle θ2 (θ1=θ2) in the counterclockwise direction from a reference line L0, line L0 being a line that extends in parallel with printing surface P1 (see FIG. 1) and passes through center $O_1$ of second small diameter portion 53. Therefore, when operation lever 90 is rotated to first stopping position 90' small diameter portion 53 is rotated through angle θ1 to a first position. When operation lever 90 is rotated to second stopping position 90" small diameter portion 53 rotates through an angle θ2 to a second position. As a result, guide shaft 50 stops at such positions reached by rotating about first and second small diameter portions 52 and 53 by the same angle θ1, θ2 (θ1=θ2) in opposite directions from each other from the reference line L0.

When operation lever 90 is set in first stopping position 90', guide shaft 50 retracts in a direction indicated by an arrow J1, whereas when operation lever 90 is set in second stopping position 90", guide shaft 50 advances in a direction indicated by an arrow J2. That is, if a print operation is to be performed on a relatively thick paper or recording medium, operation lever 90 is set to first stopping position 90', whereas if a print operation is to be performed on a relatively thin paper or recording medium, operation lever 90 is set to second stopping position 90". As a result, the distance between printing surface P1 and guide shaft 50 and print head 60 can be maintained within a prescribed range (see FIG. 1).

Regardless of the position of guide shaft 50, the rotation angle of operation lever 90 from reference line L0 is the same (θ1=T2) as described above. Therefore, center $O_0$ of guide shaft 50 stays in the same position with respect to a direction indicated by an arrow Y. Therefore, as a result of this construction, by turning operation lever 90 to first stopping position 90' or to second stopping position 90", guide shaft 50 can advance toward or retract from printing surface P1 without shifting in the paper forward direction Y, and while maintaining the parallel condition of the guide shaft with respect to the printing surface.

While the neutral position of operation lever 90 is indicated by a solid line for convenience in FIG. 13, operation lever 90 is maintained either in first stopping position 90' or in second stopping position 90" when the printer is in use. Thus, operation lever 90 is never in the neutral position during printer use.

A cap 100 is slidably fixed to second frame 72 and is positioned adjacent a second end 55 of guide shaft 50. Cap 100 is vertically slidable (in directions indicated by arrows K1, K2) by a sliding mechanism (not shown), and its movement is restricted so as not to move in the paper forward, or paper feed, direction (in the direction indicated by the arrow Y). When printer 40 is not in operation or in a like condition, cap 100 moves upward upon return of carriage 61 to a position adjacent second frame 72 and covers ink ejection surface 63 of print head 60.

Sheet detector 110 is arranged along a paper feed path through which paper P is forwarded to detect a leading edge of paper P. When the leading edge of paper P reaches detector 110, a signal is then emitted from sheet detector 110. Upon receipt of this signal by a paper forwarding means (not shown), the paper forwarding means performs a "head-end setting", in which paper P is forwarded a predetermined amount after receipt of the signal. Thus, the print start position can be determined, and paper P be forwarded a proper amount.

The thus constructed printer provides the following advantages.

(i) Print head 60 is supported by guide shaft 50 which is in turn supported by first and second frames 71 and 72, so that data is printed on printing surface P1 with print head 60 reciprocating along the length of guide shaft 50.

(ii) First small diameter portion 52 of guide shaft 50 is supported by bearing member 80 that is rotatably fitted into substantially square hole 71*a* formed in the frame 71. Bearing member 80 is made of a resilient material and biases first small diameter portion 52 of guide shaft 50 onto straight contact side a1 of substantially square hole 71*a* by the resiliency thereof. As a result, when bearing member 80 is rotated, first small diameter portion 52 of guide shaft 50 is moved along straight contact side a1.

Since straight contact side a1 extends in a direction orthogonal to printing surface P1, first small diameter portion 52 of guide shaft 50 moves only in the direction orthogonal to printing surface P1. Hence, parallelism between printing surface P1 and guide shaft 50 can be adjusted by rotating only bearing member 80. In addition, since first small diameter portion 52 of guide shaft 50 moves only in the direction orthogonal to printing surface P1, the parallelism adjustment can be made more easily. Moreover, only bearing member 80 is required to make the parallelism adjustment of guide shaft 50, and thus a reduced number of parts are required.

(iii) Substantially square hole 71*a* of first frame 71 is formed of contact side a1, second side a2 in facing relation with contact side a1 and positioned in parallel therewith, and third and fourth sides a3 and a4 that are perpendicular to contact side a1 and second side a2 and are positioned to form a square cut out in first frame 71. First small diameter portion 52 of guide shaft 50 has a first arcuate surface c1 that comes into contact with the contact side a1, and bearing member 80 has second arcuate surface c2 that comes into contact with second side a2 and third and fourth arcuate surfaces c3, c4 that come into contact with third and fourth sides a3 and a4, respectively. Therefore, bearing member 80 can be rotated smoothly. Hence, parallelism between the printing surface P1 and the guide shaft 50 can be provided and maintained more easily. In addition, if the shape and dimensions of bearing portion 81 of bearing member 80 are set as described above, any parallelism adjustment can be made more smoothly and easily.

(iv) First small diameter portion 52 of guide shaft 50 as well as first frame 71 are made of metal, and first frame 71 is electrically grounded. Therefore, guide shaft 50 can be electrically grounded without employing any special parts. It may be noted that the same advantage can be obtained by grounding second frame 72 since not only the whole of guide shaft 50 is made of metal, but also second frame 72 is made of metal.

(v) First and second small diameter portions 52 and 53 of guide shaft 50 are eccentric with respect to the center $O_0$ of guide shaft 50. Thus, portions 52 and 53 are formed as eccentric shaft portions. Therefore, by turning these portions 52 and 53, guide shaft 50 is allowed to advance toward and retract from printing surface P1 while maintaining parallelism with respect to printing surface P1.

In addition, as long as operation lever 90 for rotating first and second small diameter portions 52 and 53 is properly operated by a user, operation lever 90 stops only in first stopping position 90' or in second stopping position 90". Further, first and second stopping positions 90', 90" are arranged so as to correspond to such positions reached by first and second small diameter portions 52 and 53 rotating in the clockwise direction or in the counterclockwise direction a predetermined distance from reference line L0 that runs in parallel with printing surface P1 and passes through center $O_1$ of the eccentric shaft portions. Therefore, by turning operation lever 90 to the first or second stopping positions, the guide shaft 50 can be advanced toward or retracted from printing surface P1 without shifting in the paper forward direction, while maintaining parallelism with respect to the printing surface. Further, since guide shaft 50 does not shift in the paper forward direction, the print start position with respect to the paper is in no way shifted erratically or affected. Only operation lever 90 is required to perform this operation.

(vi) Even if the parallelism of guide shaft 50 is adjusted, or even if the guide shaft 50 is advanced toward or retracted from printing surface P1, guide shaft 50 does not shift in the paper forward direction (in the direction indicated by the arrow Y). Therefore, ink ejection surface 63 of print head 60 can be properly covered by cap 100.

Figure 17:
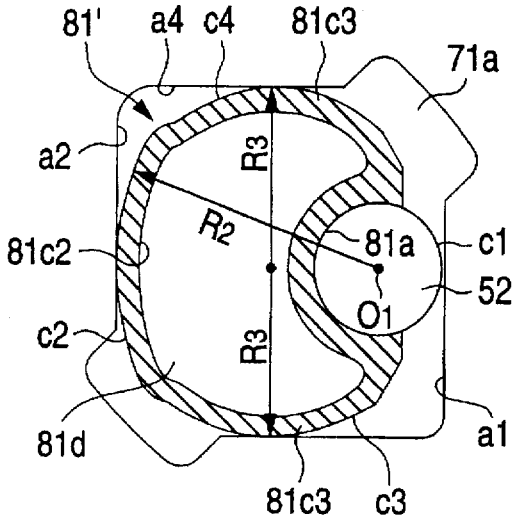
FIG. 17 is a partial cross-sectional view showing a bearing portion of a printer constructed in accordance with a second embodiment of the invention.
Figure 18:
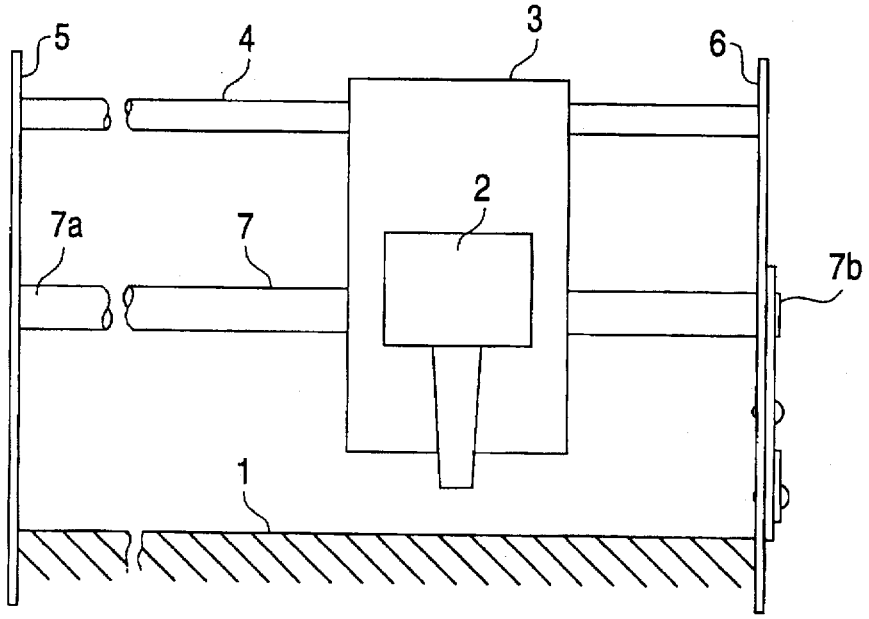
FIG. 18 PRIOR ART
FIG. 18 is a top plan view of a guide shaft assembly constructed in accordance with the prior art.
Figure 19:
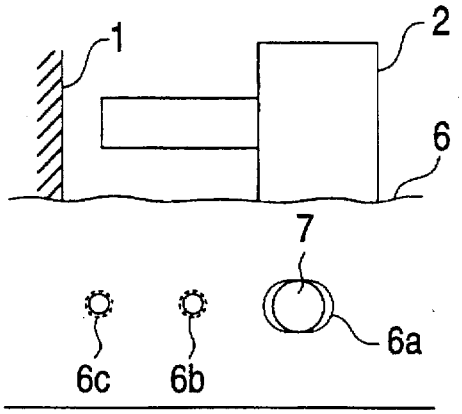
FIG. 19 PRIOR ART
FIG. 19 is a side elevational view of the prior art assembly of FIG. 18.
Figure 20:
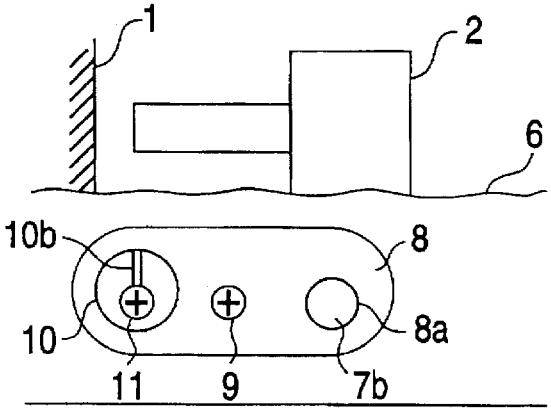
FIG. 20 PRIOR ART
FIG. 20 is a side elevational view of the prior art assembly of FIG. 18.
Figure 21:
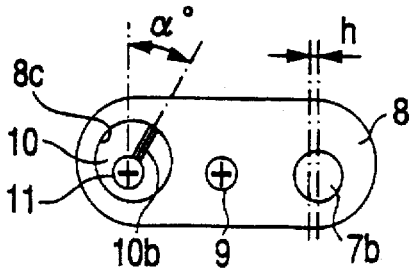
FIG. 21 PRIOR ART
FIG. 21 is a side elevational view of a bracket constructed in accordance with the prior art.
Figure 22:
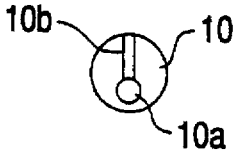
FIG. 22 PRIOR ART
FIG. 22 is an enlarged side elevational view of the bracket constructed in accordance with the prior art embodiment.
Figure 23:
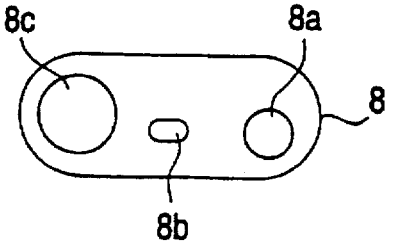
FIG. 23 PRIOR ART
FIG. 23 is a side elevational view of the bracket constructed in accordance with the prior art.
Figure 24:
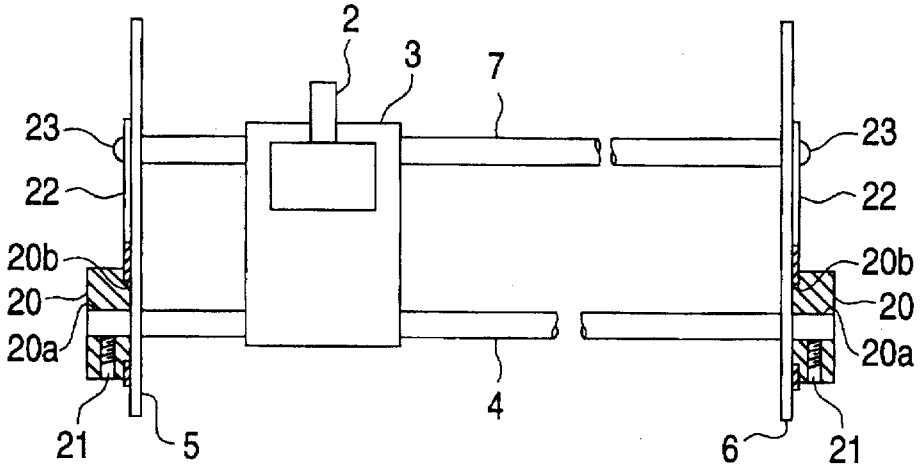
FIG. 24 PRIOR ART
FIG. 24 is a top plan view of a second guide shaft constructed in accordance with the prior art.
Figure 25:
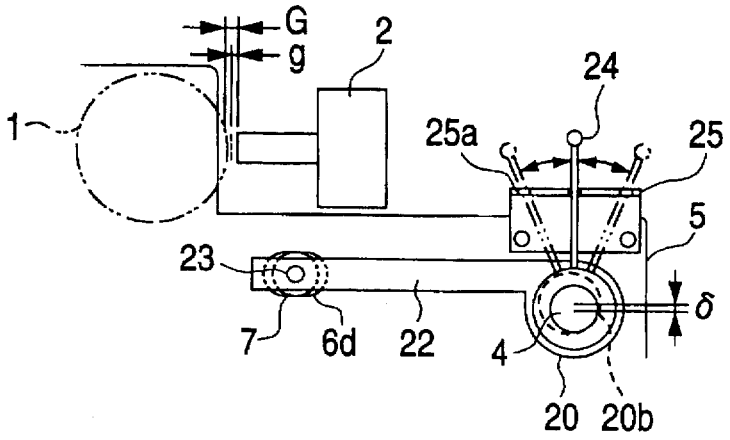
FIG. 25 PRIOR ART
FIG. 25 is a side elevational view of the prior art assembly of FIG. 18.
Figure 26:
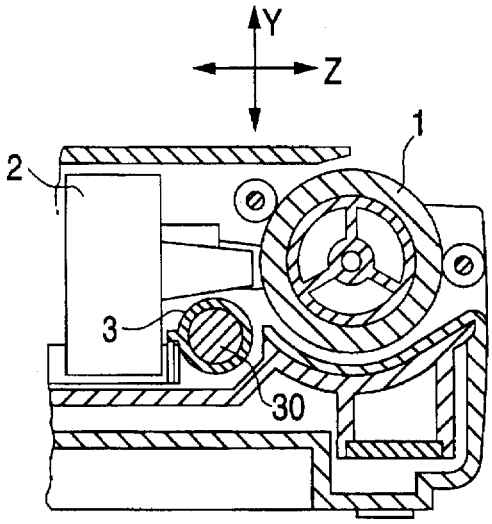
FIG. 26 PRIOR ART
FIG. 26 is a cross-sectional view of a third guide shaft assembly constructed in accordance with the prior art.
Figure 27:
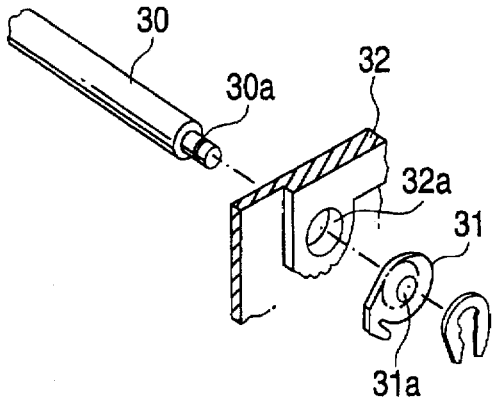
FIG. 27 PRIOR ART
FIG. 27 is an exploded perspective view of prior art assembly of FIG. 26.
Figure 28:
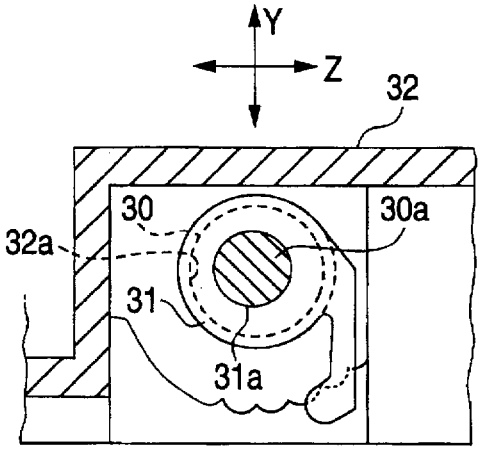
FIG. 28 PRIOR ART
FIG. 28 is a cross-sectional view of the prior art assembly of FIG. 26.

Reference is now made to FIG. 17, which depicts a partial cross-sectional view showing a guide shaft assembly of a printer constructed in accordance with a second embodiment of the invention. The second embodiment is distinguished from the first embodiment of the invention in the shape of the bearing portion of the bearing member. Other aspects of construction are the same, these like elements being given like reference numerals and discussion thereof being omitted.

In FIG. 12, reference numeral 81' denotes a bearing portion. Many of the components thereof correspond to elements of bearing portion 81 as shown in FIG. 3. Bearing portion 81' of the second embodiment is formed with a space 81*d* formed therein so that additional structural resiliency is given to arcuate portions 81*c*2, 81*c*3 and 81*c*4 that form arcuate surfaces c2, c3 and c4. As a result of this construction, not only is smoother rotation of bearing member 81' provided, but also first small diameter portion 52 can be biased onto contact side a1 more reliably. Therefore, any play between bearing portion 81' and substantially square hole 71*a* can be prevented, and guide shaft 50 can be electrically grounded more reliably as well.

Thus, parallelism may be adjusted between the guide shaft and the printing surface with a reduced number of parts. Additionally, the guide shaft can be advanced toward or retracted from the printing surface without shifting in the paper feed direction, and parallelism may be maintained with respect to the printing surface.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

For example, while only first small diameter portion 52 is disclosed as being supported by bearing member 80 in the aforementioned embodiments, second small diameter portion 53 may be supported by bearing member 80 alternatively. Thus, second small diameter portion 53 would be made elongated, and operation lever 90 would be fixed to the end of second small diameter portion 53 as it was disclosed as being fixed to first small diameter portion 52.

It is also to be understood that the following claims are intended to cover all of the generic and specific features of the invention herein described and all statements of the scope of the invention which, as a matter of language, might be said to fall therebetween.

What is claimed is:

1. A printer comprising:

a first frame;

a second frame positioned in facing relation to said first frame;

a guide shaft positioned substantially parallel with a printing surface, said guide shaft having a first end and a second end, said first frame supporting said first end of said guide shaft, said second frame supporting said second end of said guide shaft, at least one of said first and second frames being formed with an interior wall defining a through hole formed in said frame;

a print head for printing on said printing surface, said print head being supported by said guide shaft;

said interior wall further including at least a first straight contact side extending in a direction orthogonal to said printing surface; and a bearing member supporting said first end of said guide shaft, said bearing member being rotatably fitted against said interior wall and within said through hole formed thereby, said bearing member biasing said first end of said guide shaft against said first straight contact side of said interior wall.

2. The printer of claim 1, wherein the rotation of said bearing member causes said guide shaft to move in a direction orthogonal to said printing surface.

3. The printer of claim 1, wherein said bearing member is formed of a resilient material.

4. The printer of claim 1, wherein said first and second ends of said guide shaft and said at least one of said first and second frames are formed of metal, said at least one of said first and second frames being electrically grounded.

5. The printer of claim 1, wherein said first and second ends of said guide shaft are constructed so as to be eccentric with respect to a center of said guide shaft.

6. The printer of claim 2, wherein:

said interior wall further comprises a second side formed in facing relation and parallel to said first contact side, and third and fourth opposed sides, said third and fourth sides spaced apart from each other and formed parallel to each other, said third and fourth walls situated essentially perpendicularly to said first contact side and said second side, at least said first, second, third and fourth sides defining a substantially square through hole;

said first end of said guide shaft being formed with an arcuate surface, said arcuate surface being dimensioned to contact said first contact side of said interior wall; and said bearing member being formed with a second arcuate surface being dimensioned to contact said second side of said interior wall, said bearing member also being formed with a third arcuate surface and a fourth arcuate surface, each of said third and fourth arcuate surfaces dimensioned to contact said third and said fourth sides of said interior wall, respectively.

7. The printer of claim 6, wherein said bearing member is formed of a resilient material.

8. The printer of claim 3, wherein said first and second ends of said guide shaft and said at least one of said first and second frames are formed of metal, said at least one of said first and second frames being electrically grounded.

9. The printer of claim 6, wherein said first and second ends of said guide shaft are constructed so as to be eccentric with respect to a center of said guide shaft.

10. The printer according to claim 6, wherein said print head is an ink jet print head having an ink jet ejecting surface for ejecting ink droplets onto said printing surface, and further comprising a cap for covering said ink jet ejecting surface positioned adjacent one of said first and second frame member.

11. A printer comprising:

a first frame;

a second frame positioned in facing relation to said first frame;

a guide shaft positioned substantially parallel with a printing surface, said guide shaft having a first end and a second end, said first frame supporting said first end of said guide shaft, a second frame supporting said second end of said guide shaft;

a print head for printing on said printing surface, said print head being supported by said guide shaft;

at least one of said first and second frames being formed with an interior wall defining a through hole formed in said frame, said interior wall further comprising at least a first straight contact side extending in a direction orthogonal to said printing surface, said interior wall further comprising a second side formed opposed and parallel to said first contact side and spaced therefrom, and third and fourth opposed sides, said third and fourth sides being spaced apart from each other and formed parallel to each other, said third and fourth sides situated essentially perpendicularly to said first contact side and said second side, at least said first, second, third and fourth sides defining a substantially square through hole, said first end of said guide shaft being formed with a first arcuate surface having a center $O_1$ and having a radius of curvature $R_1$, said arcuate surface being dimensioned to contact said first contact side of said interior wall; and a bearing member supporting said first end of said guide shaft, said bearing member being rotatably fitted against said interior wall and within said through hole formed thereby, said first end of said guide shaft being biased against said first straight contact side of said interior wall, said bearing member being formed with a second arcuate surface, having a radius of curvature $R_2$, dimensioned to contact said second side of said interior wall, said second arcuate surface subtending a center of said first arcuate surface, said bearing member also being formed with a third arcuate surface and a fourth arcuate surface sharing a common center $O_3$ and each having a radius of curvature $R_3$, each of said third and fourth arcuate surfaces being dimensioned to contact said third and said fourth sides of said interior wall, respectively, center $O_1$ being positioned a distance A from center $O_3$, wherein:

$$R_1+R_2=2R_3; \text{ and}$$

$$R_3-R_1=A.$$

12. The printer of claim 11, wherein said bearing member is formed of a resilient material.

13. The printer of claim 11, wherein at least one of said first and second ends of said guide shaft and said at least one of said first and second frames are formed of metal, said frame being electrically grounded.

14. The printer of claim 11, wherein said first and second ends of said guide shaft are constructed so as to be eccentric with respect to a center of said guide shaft.

15. A printer comprising:

a first frame;

a second frame positioned in facing relation to said first frame;

a guide shaft having a first end and a second end, said guide shaft being supported between said frames parallel to a printing surface;

a first eccentric shaft portion being formed integral with said first end of said guide shaft, said first eccentric shaft portion being positioned parallel to said printing surface, said first frame rotatably supporting said first eccentric shaft portion;

a second eccentric shaft portion being formed integral with said second end of said guide shaft, said second eccentric shaft portion being positioned parallel to said printing surface, said second frame rotatably supporting said second eccentric shaft portion;

a print head for printing on said printing surface, said print head being supported by said guide shaft; and an operation lever operatively coupled to said second eccentric shaft portion for rotating said first and second eccentric shaft portions between a first position and a second position, said operation lever designed to stop at one of a first and second stopping position; wherein each of said first and second stopping position corresponds to said first and second position, respectively, of said first and second eccentric shaft members, said first position corresponding to rotation in a first direction of said first and second eccentric shaft members through a first angle from a plane parallel to said printing surface, said second position corresponding to rotation in a second direction of said first and second eccentric shift members through a second angle from a plane parallel to said printing surface, said first direction being opposite said second direction, and said first angle being equal to said second angle.

16. The printer of claim 15, wherein said first and second ends of said guide shaft and said at least one of said first and second frames are formed of metal, and at least one of said first frame and said second frame being electrically grounded.

17. The printer of claim 15, whereby the movement of said operation lever between said first and second positions results in the movement of said print head in a direction orthogonal to said printing surface.

18. The printer according to claim 15, wherein said print head is an ink jet print head having an ink jet ejecting surface for ejecting ink droplets onto said printing surface, and further comprising a cap for covering said ink jet ejecting surface positioned adjacent one of said first and second frame member.

19. A printer comprising:

at least a first frame, said first frame being formed with an interior wall defining a through hole formed in said frame;

a guide shaft positioned substantially parallel with a printing surface, said at least a first frame supporting said guide shaft;

a print head for printing on said printing surface, said print head being supported by said guide shaft; and a bearing member being rotatably fitted against said interior wall and within said through hole formed thereby, the rotation of said bearing member urging said guide shaft only in a direction essentially orthogonal to said printing surface.

* * * * *